US008991442B1

(12) United States Patent
Navin et al.

(10) Patent No.: US 8,991,442 B1
(45) Date of Patent: Mar. 31, 2015

(54) ROTARY FILLING MACHINE WITH MAGNETIC FUNNEL ATTACHMENT

(71) Applicant: Spee-Dee Packaging Machinery, Inc., Sturtevant, WI (US)

(72) Inventors: David Navin, Fontana, WI (US); Mark D. Green, Hilliard, OH (US)

(73) Assignee: Spee-Dee Packaging Machinery, Inc., Sturtevant, WI (US)

( * ) Notice: Subject to any disclaimer, the term of this patent is extended or adjusted under 35 U.S.C. 154(b) by 17 days.

(21) Appl. No.: 14/028,635

(22) Filed: Sep. 17, 2013

Related U.S. Application Data

(60) Provisional application No. 61/718,785, filed on Oct. 26, 2012.

(51) Int. Cl.
*B65B 1/04* (2006.01)
*B67C 11/02* (2006.01)
*B65B 59/04* (2006.01)

(52) U.S. Cl.
CPC ..... *B67C 11/02* (2013.01); *B65B 59/04* (2013.01)
USPC ..... 141/2; 141/144; 141/145; 141/331; 141/332; 141/340; 141/341; 141/387; 141/392; 222/566

(58) Field of Classification Search
USPC ..... 141/2, 10, 144–152, 266, 331–334, 141/340–343, 387, 392; 222/566, 567, 520
See application file for complete search history.

(56) References Cited

U.S. PATENT DOCUMENTS

| | | | | |
|---|---|---|---|---|
| 5,186,299 | A * | 2/1993 | Stimson | 193/2 R |
| 5,979,516 | A * | 11/1999 | Grant | 141/331 |
| 6,119,440 | A * | 9/2000 | Benner, Jr. et al. | 53/473 |
| 6,691,902 | B2 * | 2/2004 | Gomez | 222/566 |
| 7,975,734 | B2 * | 7/2011 | Makowiec et al. | 141/342 |
| 8,505,787 | B2 * | 8/2013 | Fox et al. | 222/566 |

* cited by examiner

*Primary Examiner* — Timothy L Maust
*Assistant Examiner* — Timothy P Kelly
(74) *Attorney, Agent, or Firm* — Boyle Fredrickson, S.C.

(57) ABSTRACT

A rotary filling machine includes a magnetic funnel attachment that can be easily installed, removed, and reinstalled into the machine for cleaning, changing the size of the funnel, inspecting, or replacing a damaged funnel. The magnetic funnel attachment includes a fill plate segment for receiving one or more funnels, and a funnel for attachment to the fill plate. The fill plate and funnel have mating alignment mechanisms to assist in the correct positioning of the funnel on the fill plate segment, and magnets to assist in the coupling of the funnel to the fill plate segment. This is especially helpful in creating a quick and easy method for funnel installation and removal.

20 Claims, 10 Drawing Sheets

ROTARY FILLING MACHINE WITH MAGNETIC FUNNEL ATTACHMENT

CROSS-REFERENCE TO A RELATED APPLICATION

This application claims priority under 35 U.S.C. §119 based on U.S. Provisional Patent Application No. 61/718,785, which was filed on Oct. 26, 2012, the subject matter of each of which is incorporated by reference in its entirety.

BACKGROUND OF THE INVENTION

1. Field of the Invention

This invention generally relates to the field of rotary filling machines for dispensing dry products and, more particularly, to a rotary filling machine fitted with magnetic funnel attachments for easy funnel removal and attachment.

2. Discussion of the Related Art

Rotary filling machines, sometimes referred to as rotary fillers, are routinely used for dispensing dry products into receiving containers. They can be used to fill both free-flowing and non-free-flowing products into rigid containers at rates of 100 to 400 containers per minute. Exemplary products commonly dispensed by rotary filling machines include infant formula, non-dairy creamer, spices, baking soda, drink mixes, and other products with similar characteristics. A rotary filling machine can have multiple funnels that attach to a main turret that is rotated to move the funnels around a path over the receiving container, which can be a ridged container or a pouch. A product is dispensed into the funnels and is allowed to flow into the receiving container.

Typical attachments for mounting the funnels to the turret include fasteners that bolt the funnel directly to a fill plate on the turret, spring loaded plungers that hold the funnel to the fill plate, and/or toggle clamps that hold the funnel to the fill plate. In these instances, all of these attachments have also been used in combination with tongue and groove receivers on one or more edges of the funnel.

The current attachment methods, however, suffer from drawbacks. For example, the requirements for complex mechanical fasteners render the funnels difficult to install and to remove. There are many instances in which funnels need to be removed or reinstalled in the process of using a rotary filling machine. For example, a funnel may need to be removed for cleaning, changing the size of the funnel, inspecting, or replacing a damaged funnel. However, the current methods make removing and reinstalling a funnel time-consuming and burdensome. The present invention provides an improvement over current rotary funnel attachments.

SUMMARY OF THE INVENTION

By way of summary, the present invention relates to a magnetic funnel attachment for a rotary filling machine. A primary aspect of the invention is to provide an improvement in the way funnels are attached to the turret. The present invention utilizes a magnetic system which allows the funnel to be installed and removed faster and more easily for the purposes of cleaning, changing over in sizes, inspection, or replacement.

In accordance with a first aspect of the invention, a magnetic funnel attachment is provided that includes a funnel and a fill plate. Installation of the funnel onto the fill plate may involve a two-step process. First, an interaction of alignment pins and receptacles or other alignment mechanisms on the funnel and fill plate allows for correct positioning of the funnel with respect to the fill plate. Second, magnetic forces secure the funnel to the fill plate.

In one example, two alignment pins guide the funnel into place as the magnets engage. The two alignment pins are provided on the front and hack of the fill plate to allow the funnel to be situated in the correct position during installation. The back pin aligns with a back slot of the funnel, and the front pin aligns with a front hole of the funnel so that, during installation, the back pin starts the alignment process and the front pin provides exact axial location. Other mechanical alignment locating mechanisms or features can be used instead of or in addition to the alignment pins and the corresponding hole and notch.

The magnets are mounted to the funnel and the fill plate with the poles oriented in opposite directions to allow for a pulling action by the magnets when they are in close proximity. The magnets of the funnel and fill plate may be located in pockets created in the funnel and fill plate, respectively. The pockets for the magnets can be made in several different ways. However, it is preferred that the pockets are made blind, i.e., they do not extend all the way through the funnel or fill plate, allowing for an easily cleanable surface above the magnet that is typically near the product contact zone. Alternately, a magnet may align with a ferrous material blind or surface mounted in the pockets.

A handle may be formed into or attached to the funnel to facilitate in installation and removal of the funnel from the full plate.

These and other features and aspects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

The present invention and the various features and advantageous details thereof are explained more fully with reference to the non-limiting embodiments described in detail in the following description.

Figure 1A:
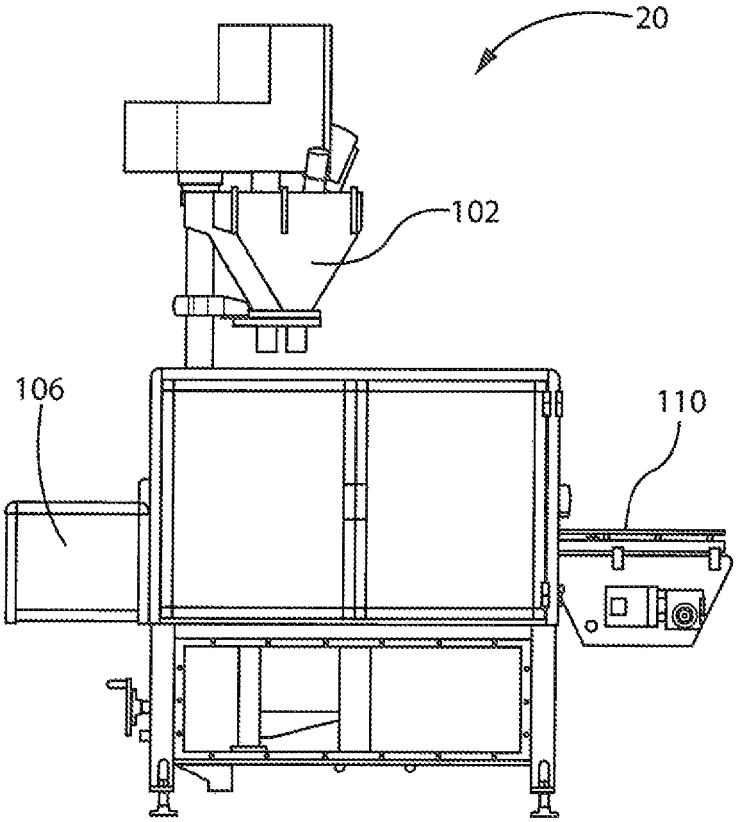
FIGS. 1A-1B are a side elevation and top plan view, respectively, showing a rotary filling machine with which a magnetic funnel attachment constructed in accordance with the invention is usable.
Figure 1B:
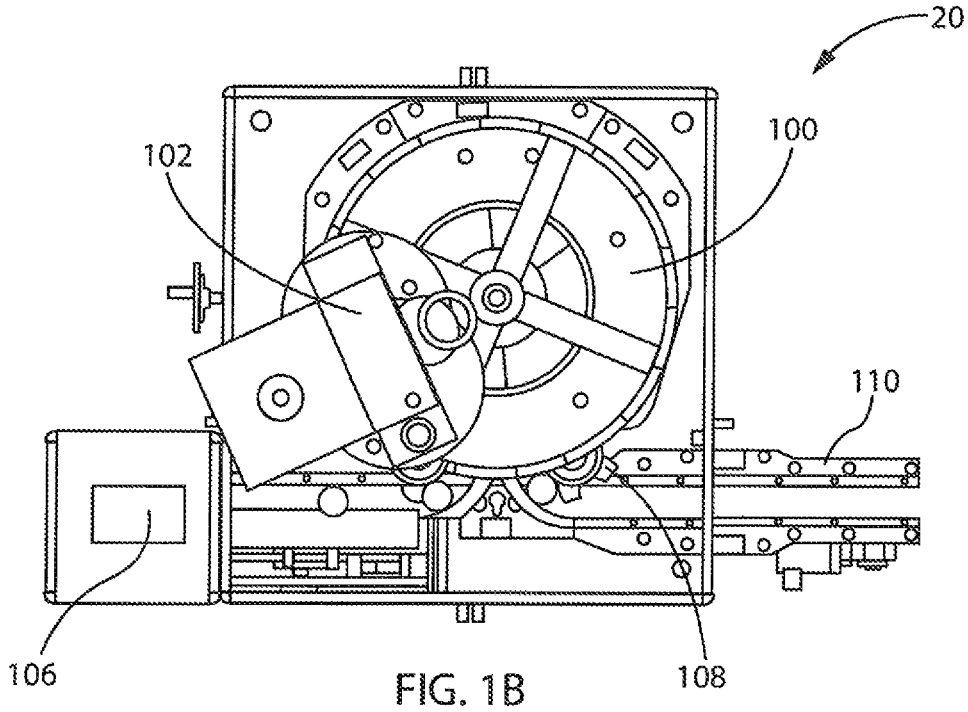
Figure 12:
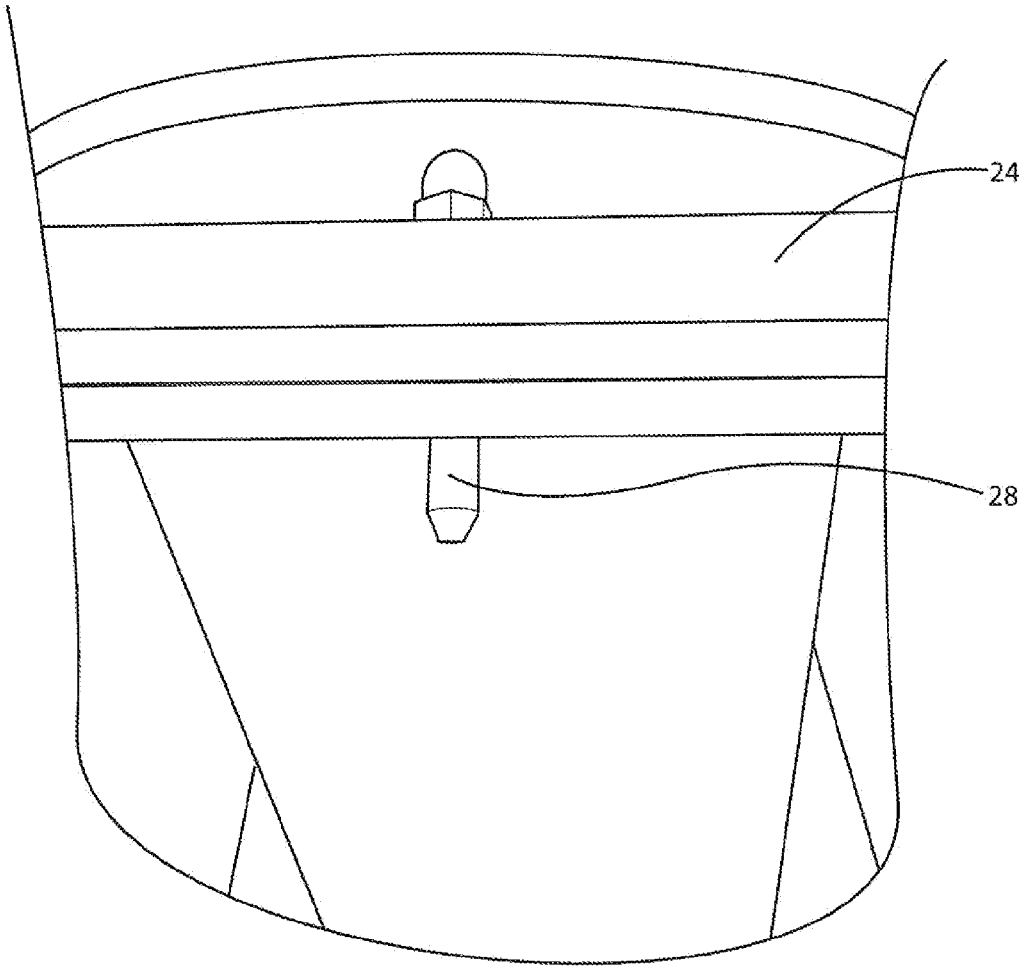
FIG. 12 is a fragmentary perspective view of a funnel of FIGS. 6-9, showing the funnel fully mounted to a corresponding fill plate segment of FIGS. 4-6.
Figure 13:
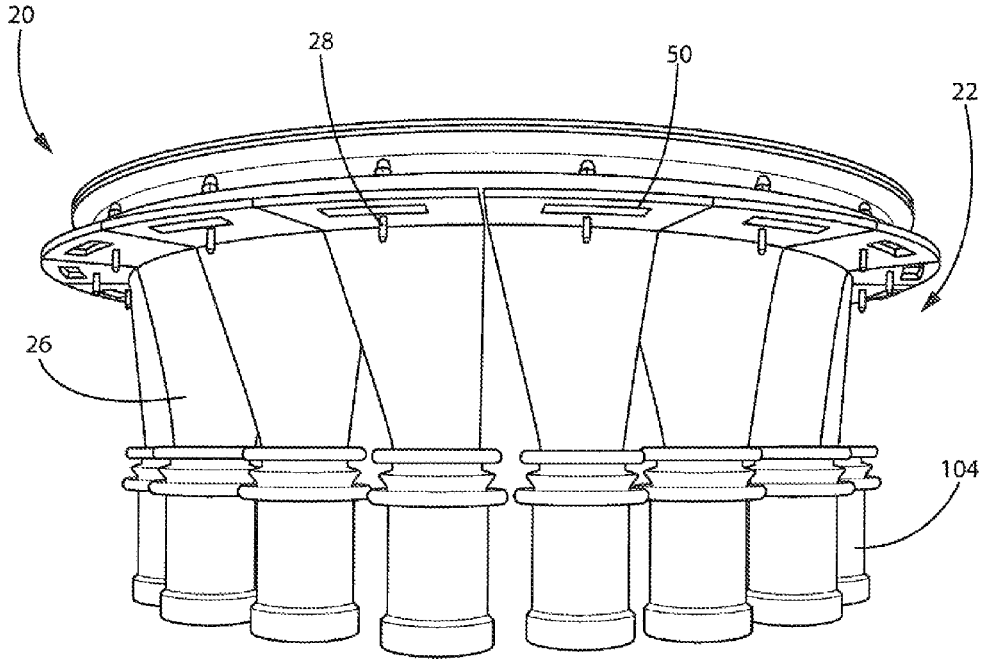
FIG. 13 is a perspective view of a portion of the rotary filling machine of FIGS. 1 and 2 with all of the funnels installed thereon using the funnel attachment assemblies of FIGS. 2-12.

Referring first to FIGS. 1A, 1B, and 13, a rotary filling machine 20 for dispensing flowable or non flowable dry products is illustrated and may include magnetic funnel attachments 22 (FIGS. 2-13) constructed in accordance with the present invention. The rotary filling machine has multiple funnels 26 that are attached to a main turret 100. The main turret 100 is rotated to move the funnels 26 around a path under a dispensing funnel 102 or other dispensing mechanism and over a receiving container 104 (FIG. 13), which can be a ridged container or a pouch. Each funnel 26 dispenses a controlled amount of materials into the associated receiving container 104. The receiving containers 104 feed into a series of rotating star wheels 106 and/or timing screws and then into the main turret 100.

In operation, the containers 104 are timed via an initial star that syncs and transfers the containers to the main turret 100, which transports the containers 104 and corresponding funnels 26. The containers 104 and their associated funnels 26 are then transported beneath the dispensing funnel 102, where a controlled amount of dry product is dispensed into the funnels 26. Products can be dispensed to the dispensing funnel 102 using, for example an auger filler, a volumetric cup filler, a combination or linear scale, or any other filling mechanism that can continuously feed dry product or time the drop of the product into a funnel. The product then flows through the funnel 26 and into the container 104 being transported around the main turret 100, thus allowing the product to settle into the container 104 as the main turret 100 continues to rotate. At the discharge of the main turret 100, containers 104 are received by another timing star wheel 108 (FIG. 13) to transfer the containers 104 from the main turret 100 to the discharge conveyor 110.

A plurality of magnetic funnel attachments 22 may be attached to the turret 100 of the rotary filling machine 20 to provide for the mounting of funnels 26 in an annular pattern circumferentially around the main turret 100 of machine 20, as seen from above in FIGS. 2 and 10-13.

Figure 2:
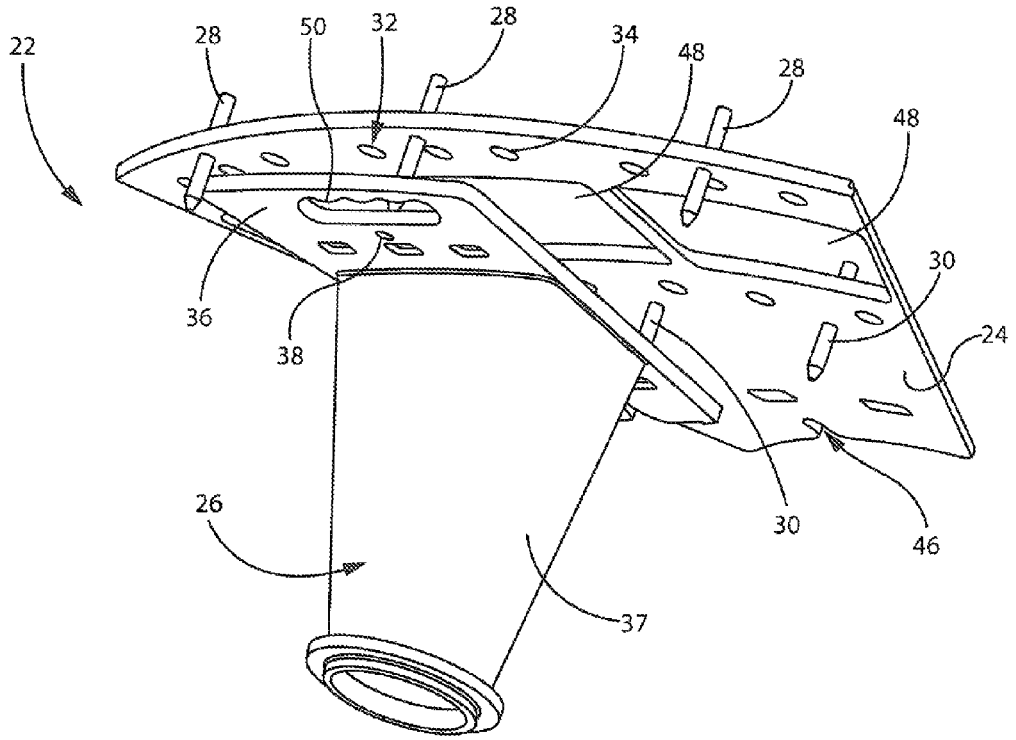
FIG. 2 is a perspective view of a magnetic funnel attachment assembly usable with the rotary filling machine of FIGS. 1A and 1B and constructed according to an embodiment of the present invention.
Figure 5:
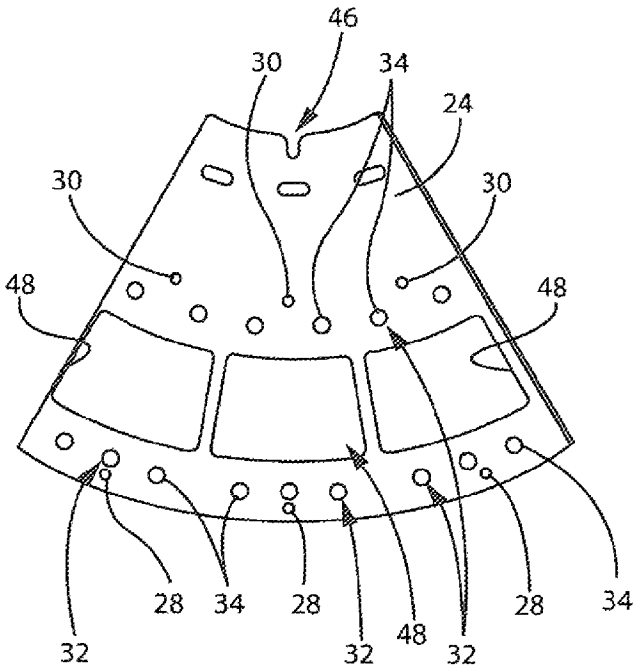
FIG. 5 is a bottom plan view of the fill plate segment of FIGS. 2 and 3.
Figure 3:
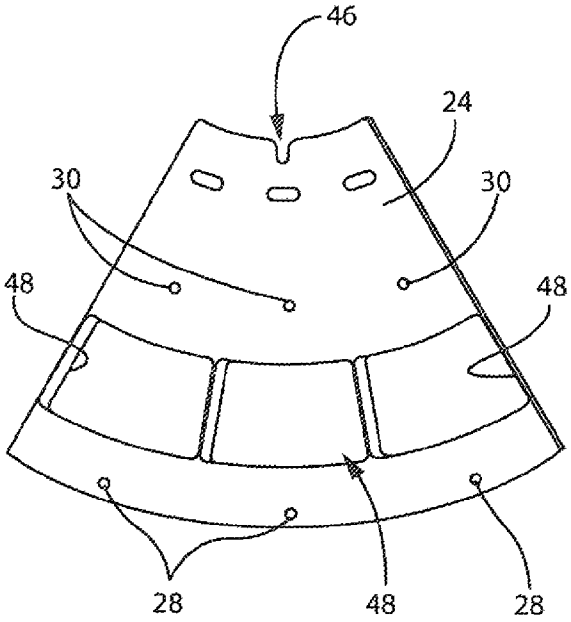
FIG. 3 is a top plan view of a fill plate segment of the magnetic funnel attachment assembly of FIG. 2.

Referring now to FIGS. 2-5, each magnetic funnel attachment 22 includes 1) a segment 24 of a fill plate and 2) one or more funnels 26 attached to a bottom surface of each fill plate segment 24. The circumferentially arranged fill plate segments 24 may be formed on a unitary or segmented ring attached to and moving with the main turret 100. In the illustrated embodiment, each fill plate segment 24 receives three funnels 26 at three evenly spaced mounting locations as best seen in FIGS. 2, 3, and 5. Each counting location has a central opening that opens into a respective funnel 26. Each fill plate segment 24 may be formed from a rigid, durable material such as aluminum or steel.

Figure 4:
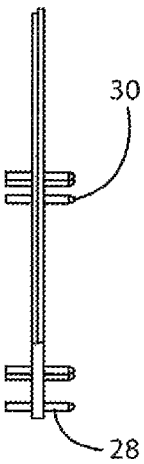
FIG. 4 is a side elevation view of the fill plate segment of FIG. 2.

Each mounting location of each fill plate segment 24 has a front aligning pin 28 and a back aligning pin 30 that each penetrate the fill plate 24 and protrude outwardly from the top and bottom surfaces of the fill plate 24, as seen from the side view in FIG. 4. The front aligning pin 28 and rear aligning pin 30 assist to couple the fill plate 24 to the rotary filling machine 20 and to properly align the funnel 26 with an associated fill opening 48 in the fill plate segment 24 through which product flows during a filling operation. Moreover, a back notch 46 may be formed in the fill plate segment 24 to help locate the fill plate segment 24 at the appropriate location on rotary filling machine 20 by, for instance, mating with a pin or similar protuberances (not shown) on the main turret 100.

Figure 10:
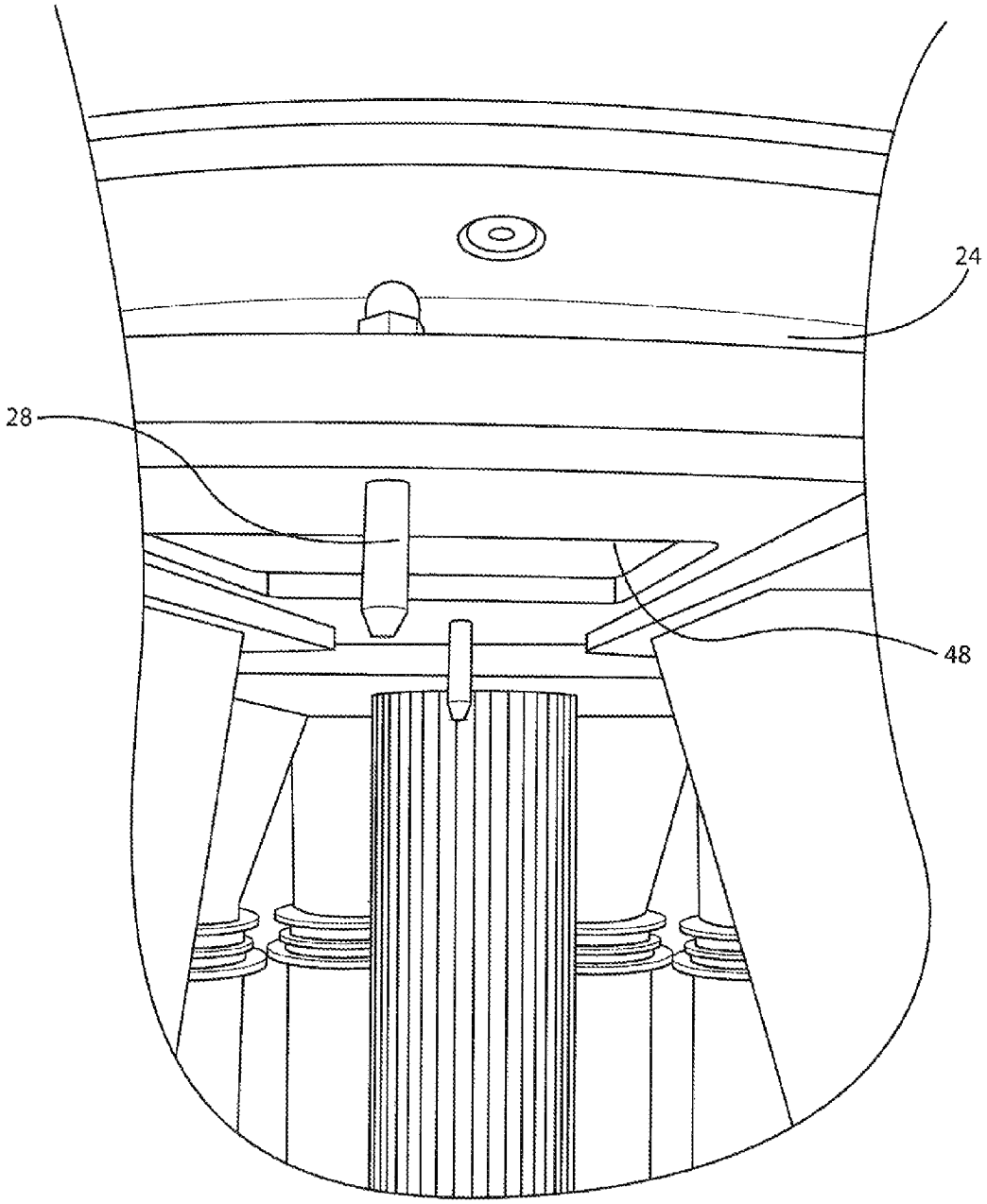
FIG. 10 is a fragmentary perspective view of the fill plate segment of FIGS. 4-6
Figure 11:
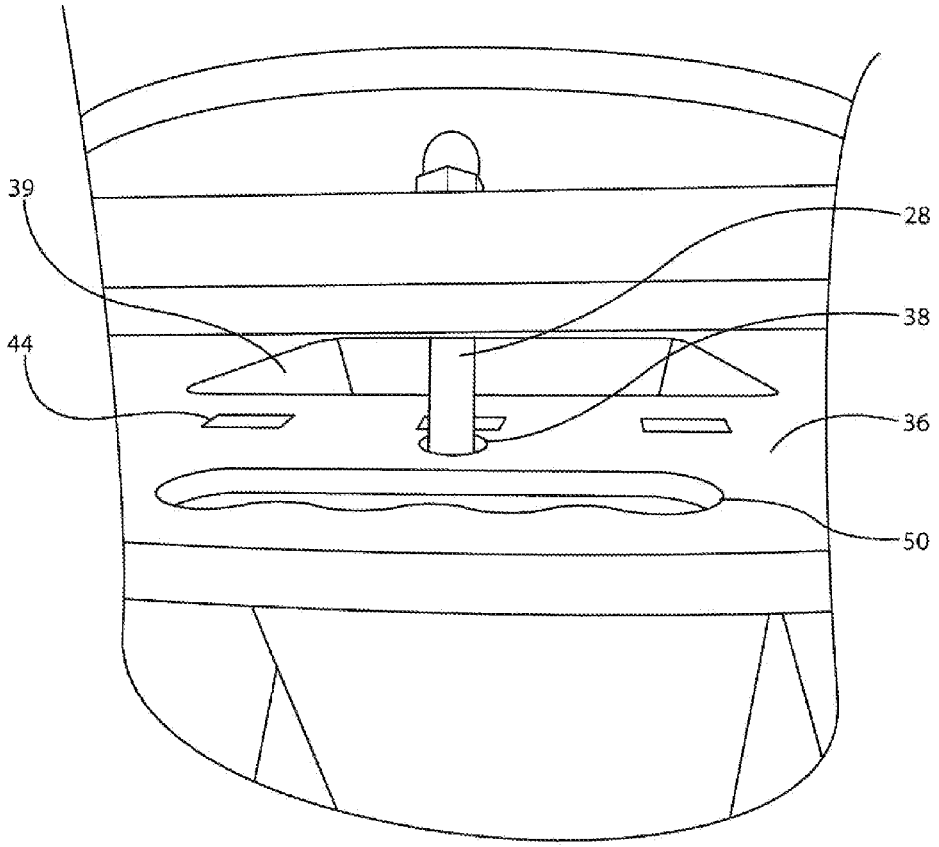
FIG. 11 is a fragmentary perspective view showing an intermediate position of the mounting of a funnel of FIGS. 6-9 on a corresponding fill plate segment of FIGS. 4-6.

Referring briefly to FIGS. 10-12, each fill plate segment 24 is coupled to the rotary filling machine 20 via the upwardly extending front aligning pin 28 and back aligning pin 30. Specifically, these pins 28 and 30 extend upwardly through apertures in an annual shoulder on the main turret 100 and receive fasteners such as nuts.

At least one magnet is provided on at least one of the fill plate segment 24 and the base plate 36 for securing the base plate 36 to the corresponding mounting location on the fill plate segment 24. If one or both of the fill plate segment 24 and the base plate 36 are formed from stainless steel or another magnetizable material, a magnet conceivably could be provided in only one of the fill plate segment 24 and the base plate 36. It is presently preferred, however, that magnets be provided in both the fill plate segment 24 and the base plate. Hence, referring to FIGS. 2, 3, and 5 each fill plate segment 24 has a plurality of fill plate pockets 32 on the front end and the back end thereof. The fill plate pockets 32 carry a plurality of first magnets 34. The fill plate pockets 32 preferably are made "blind" so that the pockets 32 do not go all the way through the fill plate segment 24 so that, while the face of the magnets 34 may be exposed from the bottom of the plate, as seen in FIG. 5, they are not exposed from the top of the fill plate segment 24, as seen in FIG. 3. This provides for a smooth surface on the top of the fill plate segment 24, which contacts the rotary filling machine 20. Each magnet 34 may be mounted in the corresponding pocket 32 by, for example, one or more of a press fit, a chemical bond with an adhesive, and a mechanical bond with a fastener.

Referring now to FIGS. 6-9, each funnel 26 has a horizontal base plate 36 and a hollow generally frusto-conical funnel body 37 extending downwardly from the bottom surface of the base pate 36. Suitable materials for each funnel 26 include, but are not limited to, stainless steel, mild steel, aluminium other metals, plastic, fiberglass, urethane and other synthetic materials that can be molded. The funnel 26 may also be created on a 3D printer. A central aperture 39 is formed through the base plate 36. Aperture 39 is surrounded by the funnel body 37 and has a size and shape that at least generally correspond to those of the corresponding opening 48 in the fill plate segment 24.

First and second alignment mechanisms are provided on the base plate 36 and the fill plate segment 24 for assuring proper positioning of the funnel 26 on the machine. The base plate 36 of this embodiment carries one or more receptacles for mating with one or more alignment devices on the fill plate segment 24. In the illustrated embodiment, the base plate 36 carries two pin receptacles for mating with the corresponding pins 28 and 30 in the fill plate segment 24. The pin receptacles take the form of a front hole 38 and a back notch 40 located in front of and behind the funnel body 37, respectively. The hole 38 and notch 40 mate with the front and rear pins 28 and 30 respectively, of the corresponding fill plate segment 24.

It should be noted that the pins 28 and 30 on the base plate segment 24 and the hole 38 and notch 40 on the funnel base plate 36 could be replaced with other alignment mechanisms or features that assure the desired alignment of the funnel 26 with the corresponding receiving area of the base plate segment 24. For example, upwardly facing pins or other protuberances could be provided on the funnel base plate 36 for mating with corresponding holes, notches, or other receptacles in the base plate segment 24.

Figure 6:
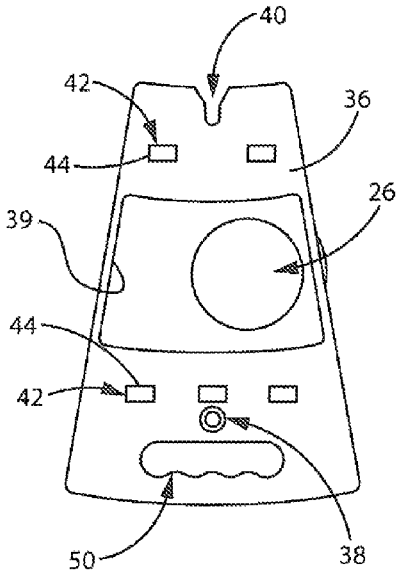
FIG. 6 is a top elevation view of one embodiment of a funnel of the funnel attachment assembly of FIG. 2.
Figure 7:
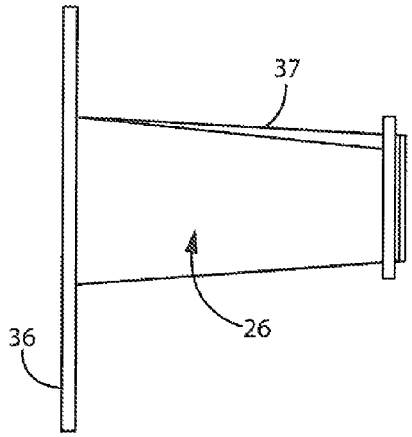
FIG. 7 is a side elevation view of the funnel of FIG. 6.
Figure 8:
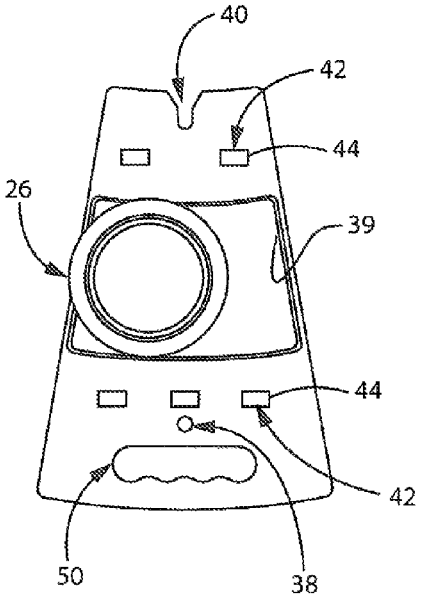
FIG. 8 is a bottom plan view of the funnel of FIGS. 6 and 7.
Figure 9:
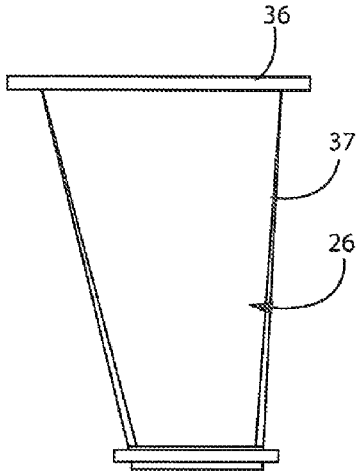
FIG. 9 is a front elevation view of the funnel of FIGS. 6-8.
Figure 14:
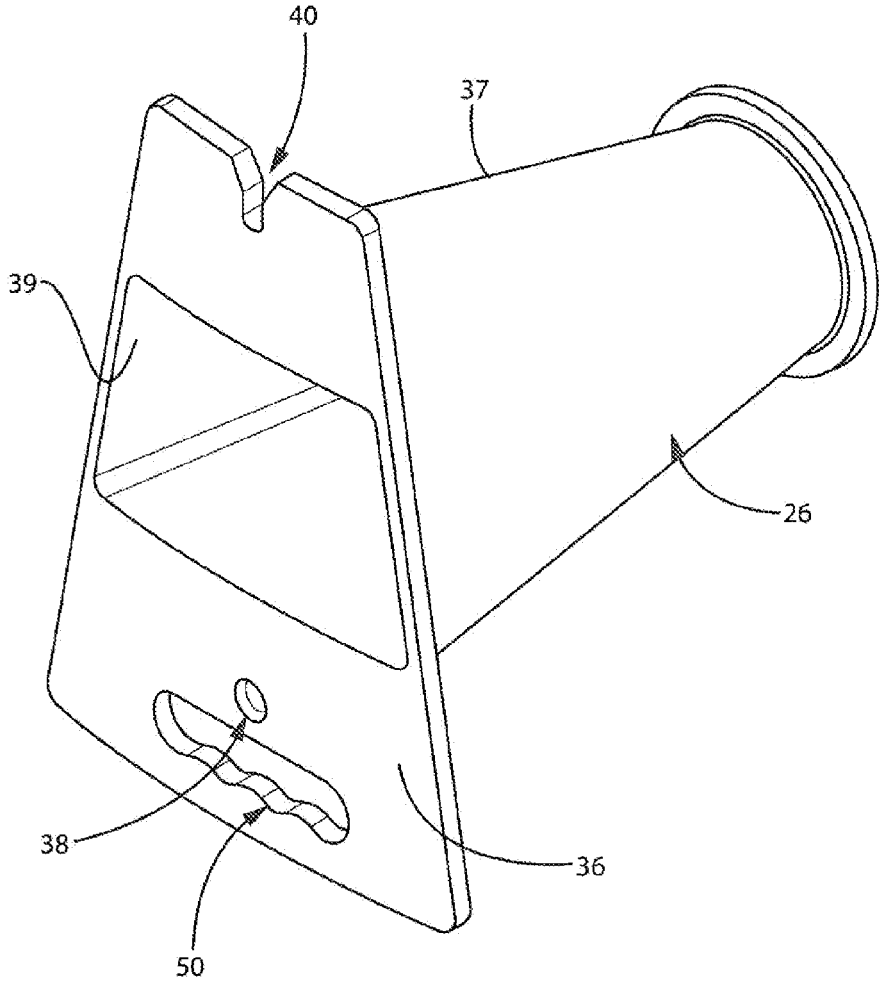
FIG. 14 is a perspective view of an alternative magnetic funnel assembly.
Figure 15:
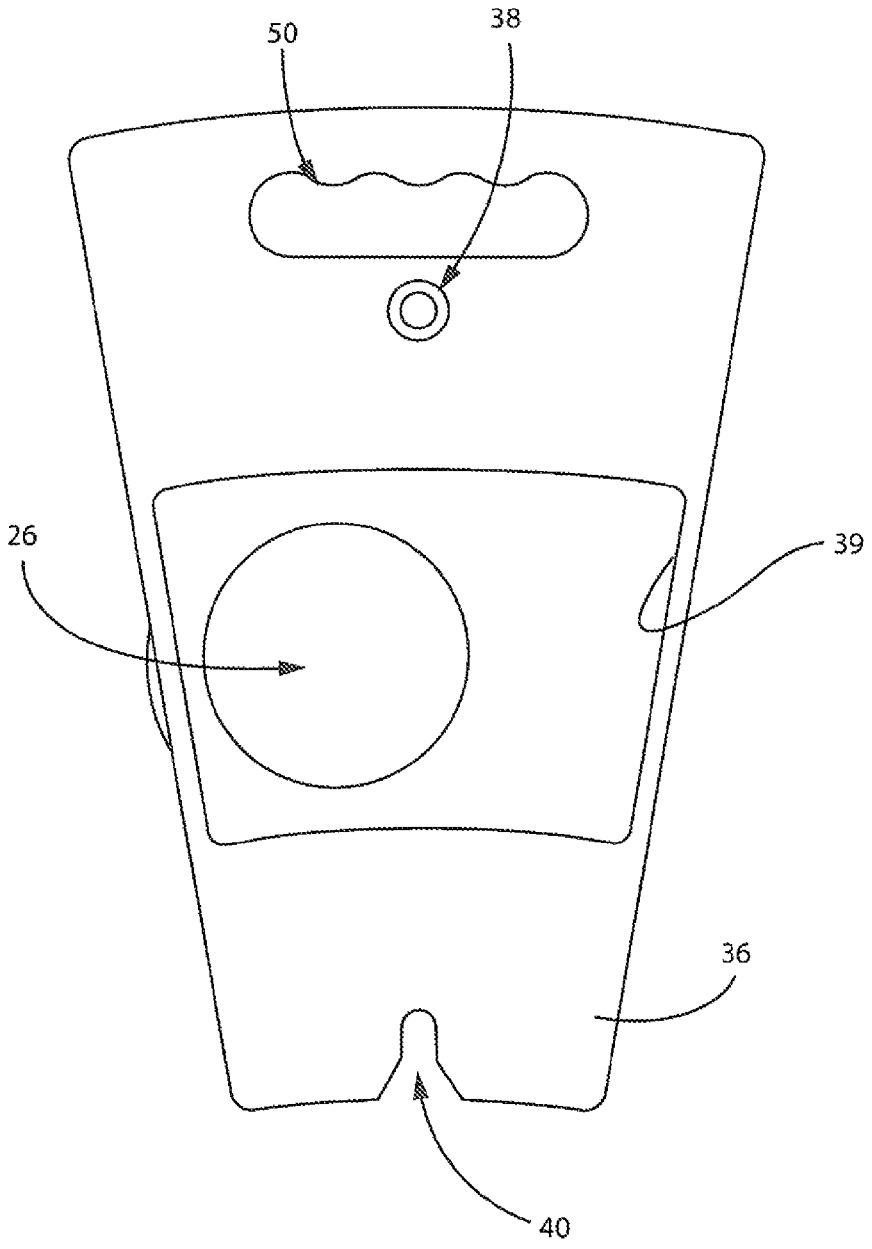
FIG. 15 is a top elevation view of the magnet funnel assembly of FIG. 14.

Referring to FIGS. 6 and 8, the base plate 36 has a plurality of pockets 42 in front of and behind the opening 39 that are alignable with the fill plate pockets 32 of the fill plate segment 24. The base pockets 42 carry a plurality of second magnets 44 with opposite polarity as the first magnets 34. In one embodiment as shown in FIGS. 14-15, the base pockets 42 will be "blind pockets" that stop short of the top surface of the base plate 36. This allows the top surface of the base plate 36 to be free of uneven surfaces, which allows the base plate 36 to easily be cleaned after use. Each second magnet 44 may be mounted in the corresponding pocket 42 by, for example, one or more of a press fit, a chemical bond with an adhesive, and a mechanical bond with a fastener. In this embodiment, the second magnets 44 will be sufficiently strong to attract the first magnets 34 through the base plate 36. A handle opening 50 may be formed in or through the front end of the base plate 36 to assist the user in attachment and removal of the funnel 26. The handle opening 50 could be supplemented with or replaced by a knob, if desired.

Alternatively, the base pockets 42 may extend through the base plate 36 so that the faces of the second magnets 44 are exposed from the top and bottom of the base plate 36, as seen in FIGS. 6 and 8. In another embodiment, the pockets 42 may be "blind pockets" that stop short of the bottom surface of the base plate 36. In either case, each magnet 44 preferably is mounted in the corresponding pocket 42 so that its upper face is exposed and thus capable of direct contact with the mating magnet 34 in the fill plate segment 24. Each magnet 44 may be mounted in the corresponding pocket 42 by, for example, one or more of a press fit, a chemical bond with an adhesive, and a mechanical bond with a fastener. A handle opening 50 may be formed in or through the front end of the base plate 36 to assist the user in attachment and removal of the funnel 26. The handle opening 50 could be supplemented with or replaced by a knob, if desired.

Referring now to FIGS. 10-12 and initially to FIG. 10, the funnel 26 is mounted on the fill plate segment 24 using only one hand by grasping the funnel 26 using the handle opening 50 and inserting the back aligning pin 30 of the fill plate 24 with the back notch 40 of the base plate 36. Referring now to FIG. 11, the funnel 26 is then pivoted upwardly so that the front aligning pin 28 is inserted into the front hole 38 of the base 36. As the second magnets 44 approach the first magnets 34, the magnetic force attracts the funnel 26 to the fill plate segment 24 to create a strong attachment, as seen in FIG. 12. Alternately, the magnet may be attracted to a metal plate.

To remove a funnel 26, all one needs to do is to grasp the handle opening 50 and pull the funnel 26 down against the resistance of the magnets 34, 44 to a position in which the hole 38 in the base plate 36 clears the bottom end of the front aligning pin 28 in the base plate segment 24, whereupon the funnel 26 can then be pulled forwardly and downwardly with the notch 40 in the base plate 36 moving away from the rear aligning pin 30 in the base plate segment 24.

Many changes and modifications could be made to the invention without departing from the spirit thereof. The scope of these changes and modifications will become apparent from the appended claims.

What is claimed is:

1. A magnetic funnel attachment for a rotary filling machine comprising:

a fill plate segment having at least one alignment mechanism;

a funnel having a base and a funnel body, wherein the funnel base has at least one alignment mechanism configured for mating with the alignment mechanism of the fill plate segment; and at least one magnet on at least one of the fill plate segment and the funnel base, for securing the funnel to the fill plate segment.

2. The magnetic funnel attachment of claim 1, wherein the alignment mechanisms of the fill plate segment and the funnel base comprise a pin and a pin receptacle, respectively.

3. The magnetic funnel attachment of claim 1, wherein the funnel base has a handle to assist in gripping the funnel.

4. The magnetic funnel attachment of claim 1, wherein the magnets include a magnet of a first polarity on the fill plate segment and a magnet of a second, opposite polarity on the base of the funnel.

5. The magnetic funnel attachment of claim 4, wherein the magnet on the fill plate segment is exposed on no more than one side of the fill plate segment.

6. The magnetic funnel attachment of claim 4, wherein the magnet on the funnel base is exposed on no more than one side of the funnel base.

7. The magnetic funnel attachment of claim 1, wherein the funnel is composed of one of stainless steel and a plastic.

8. The magnetic funnel attachment of claim 1, wherein the funnel is created on a 3D printer.

9. The magnetic funnel attachment of claim 1, wherein the fill plate segment has a plurality of mounting locations for receiving a corresponding plurality of funnels.

10. A method of attaching a funnel to a rotary filler machine, the filling machine having circumferentially-arranged fill plate segments, and the funnel having a base and a body extending downwardly from the base, the method comprising the steps of:

aligning a first alignment mechanism on the funnel base with a second alignment mechanism on one of the fill plate segments; and securing the funnel base to the fill plate segment using at least one magnet on at least one of the funnel base and the fill plate segment.

11. The method of claim 10, wherein the first and second alignment mechanisms comprise a pin receptacle and a pin, respectively.

12. The method of claim 10, wherein the securing step comprises engaging magnets of a first polarity on the funnel base with magnets of a second, opposite polarity on the fill plate segment.

13. The method of claim 12, wherein the magnets on the fill plate segments are exposed on no more than one side of each fill plate segment.

14. The method of claim 12, wherein the magnets on the funnel bases are exposed on no more than one side of each funnel base.

15. The method of claim 10, wherein each funnel base is composed of one of stainless steel and a plastic.

16. The method of claim 10, wherein each funnel base is created on a 3D printer.

17. A rotary filling machine comprising:

a rotatable main turret positioned at least in part under a product dispenser and over a product receptacle, the turret having a plurality of circumferentially-arranged fill plate segments each having at least one opening formed therethrough for alignment with an interior of a corresponding funnel;

a plurality of funnels each having a base and a funnel body; and a mounting arrangement for removeably mounting the funnels on the turret, the mounting arrangement comprising a first plurality of alignment mechanisms, at least one of which is provided on each fill plate segment, a second plurality of alignment mechanism, at least one of which is provided on each funnel base and which is configured for mating with a corresponding alignment mechanism on the fill plate segment; and a plurality of magnets, at least one of which provided on at least one of 1) each fill plate segment and 2) each funnel base, for securing the funnel to the fill plate segment.

18. The rotary filling machine of claim 17, wherein the alignment mechanisms comprise alignment pins on one of the fill plate segments and the funnel bases and pin receptacles on the other of the funnel bases and the fill plate segments.

19. The rotary filling machine of claim 17, wherein magnets are provided in pockets of the fill plate segments and are only exposed on one side of each fill plate segment.

20. The rotary filling machine of claim 17, wherein magnets are provided in pockets in the funnel bases and are exposed on no more than one side of each funnel base.

* * * * *